United States Patent [19]

McComb

[11] 4,192,023

[45] Mar. 11, 1980

[54] BIDETS OR LIKE APPARATUS

[76] Inventor: Barry P. McComb, 62 Court Rd., Orpington, Kent, England

[21] Appl. No.: 941,710

[22] Filed: Sep. 12, 1978

[30] Foreign Application Priority Data

Sep. 15, 1977 [GB] United Kingdom ..... 38518/77

[51] Int. Cl.[2] ..... A47K 3/22; A47K 11/08

[52] U.S. Cl. ..... 4/7; 4/6

[58] Field of Search ..... 4/6, 7

[56] References Cited

U.S. PATENT DOCUMENTS

| | | | |
|---|---|---|---|
| 2,605,477 | 8/1952 | Monserrat | 4/7 |
| 2,995,759 | 8/1961 | Gentry | 4/7 |
| 3,154,793 | 11/1964 | Congdon | 4/7 |
| 3,247,524 | 4/1966 | Umann | 4/7 |
| 3,513,487 | 5/1970 | Palermo et al. | 4/7 |
| 3,662,407 | 5/1972 | Colucci | 4/7 |
| 3,781,919 | 1/1974 | Dyala | 4/7 |
| 3,808,608 | 5/1974 | Caplan | 4/7 |
| 3,810,260 | 5/1974 | Lodi | 4/7 |
| 3,914,804 | 10/1975 | Schrader et al. | 4/7 |
| 4,123,807 | 11/1978 | Oguma et al. | 4/7 |

*Primary Examiner*—Henry K. Artis

*Attorney, Agent, or Firm*—James C. Wray

[57] ABSTRACT

The invention provide a water washing bidet-like apparatus for use with a normal water flushing toilet and comprises a nozzle (27) which can be normally located directly underneath the flushing rim of the toilet pan and moved by the user to an operative position, combined with electrical heater (41) for heating the water before supply to the nozzle, a thermostat (47) for switching off the electrical supply to the heater when the temperature of the water reaches a predetermined degree, and a pump (18) brought into use by the user for pumping water to the nozzle.

6 Claims, 6 Drawing Figures

16
A
18
31
26
23A
28
27
28A
10
24
20
31A
32A
32
52
32B
23A
33
A 28
30
27
28A
28B

BIDETS OR LIKE APPARATUS

This invention relates to bidets or the like apparatus and one object is to minimize occupation of space. A further object is to provide an apparatus which simplifies use by the user.

According to the invention I provide a bidet or like apparatus comprising a nozzle, means for supporting the nozzle within a lavatory pan underneath the flushing rim thereof, nozzle actuating means for moving the nozzle to and from an operative position, a container for containing water, means for supplying water to the container, heating means for heating the water in the container, thermostat means for controlling the temperature of the water in the container, operating means for operation by the user, said operating means being operatively connected with the water supply means, with the nozzle actuating means, and with the heating means to operate them.

In one form of the invention the nozzle is connected with a horizontal water supply pipe which is rotatable about its axis to bring the nozzle to and from its operative position.

In a preferred form of the invention I provide a bidet or like apparatus as defined above wherein the nozzle actuating apparatus includes a hand operable member having a normal "off" position and operable by the user into a start position and an operating position, a latch for holding the nozzle in its position underneath the rim, means to release the latch when the temperature of the water in the container reaches a predetermined degree, means to move the member to the "off" position upon release of the latch, said member in the start position rendering the heating means operative, and said member in the operative position serves to render the water supply means operative to supply cold water to the lower part of the container to cause warm water to flow from the upper part of the container to the nozzle.

A constructional form of the invention will be described by way of example with reference to the accompanying drawings wherein.

Figure 2:
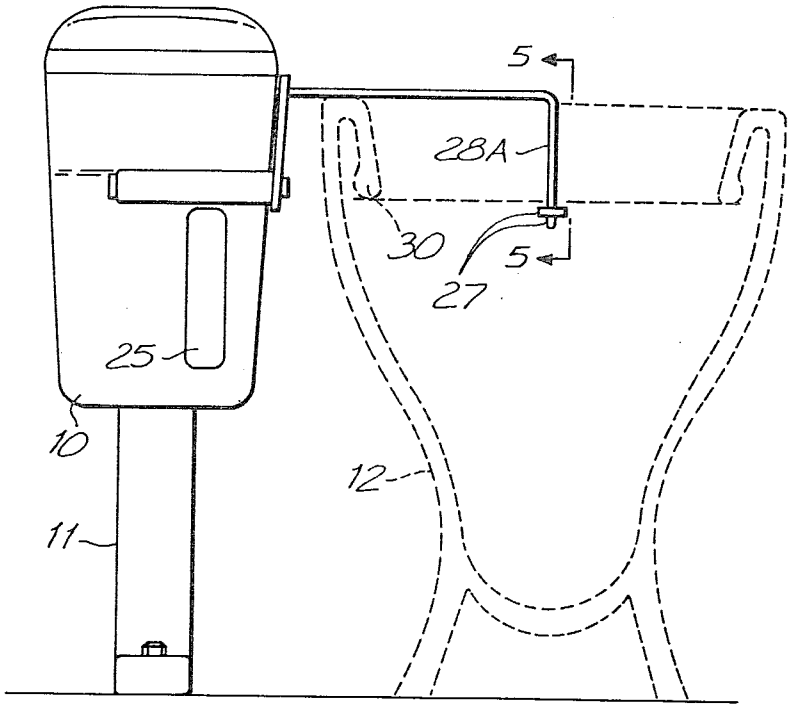
FIG. 2 is a front view thereof with adjacent toilet pan.
Figure 1:
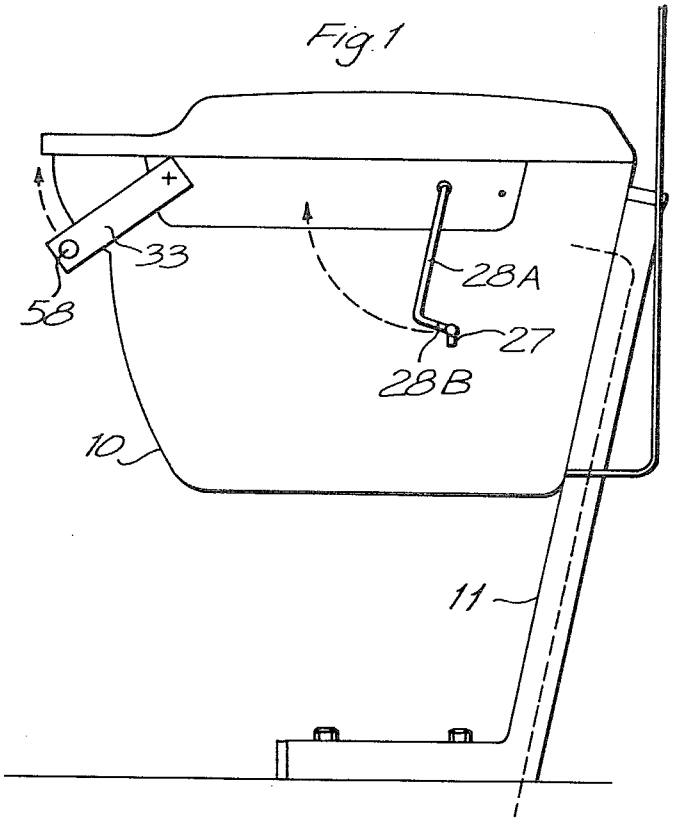
FIG. 1 is a side elevational view of a bidet or like apparatus made in accordance with the invention.

The apparatus comprises a housing 10 supported on a stand 11 adjacent to the toilet pan 12. Within the housing 10 is a water container 16 which is closed except for an inlet and an outlet. The inlet is a pipe 17 at the lower end of the container. The inlet pipe is supplied by an electrically driven pump 18 which draws water through a pipe 19 from the normal water tank. A water outlet pipe 26 is located near the top of the container. A reservoir 23 for a liquid additive such as soap or disinfectant is connected by a small bore pipe 24 to the outlet pipe 26 via a non-return valve 20. A window 25 (FIG. 2) enables the user to check the level of the additive. An electrically driven pump 21 draws the additive from the reservoir 23 through pipe 23A and supplies it to the pipe 24.

Figures 3, 5:
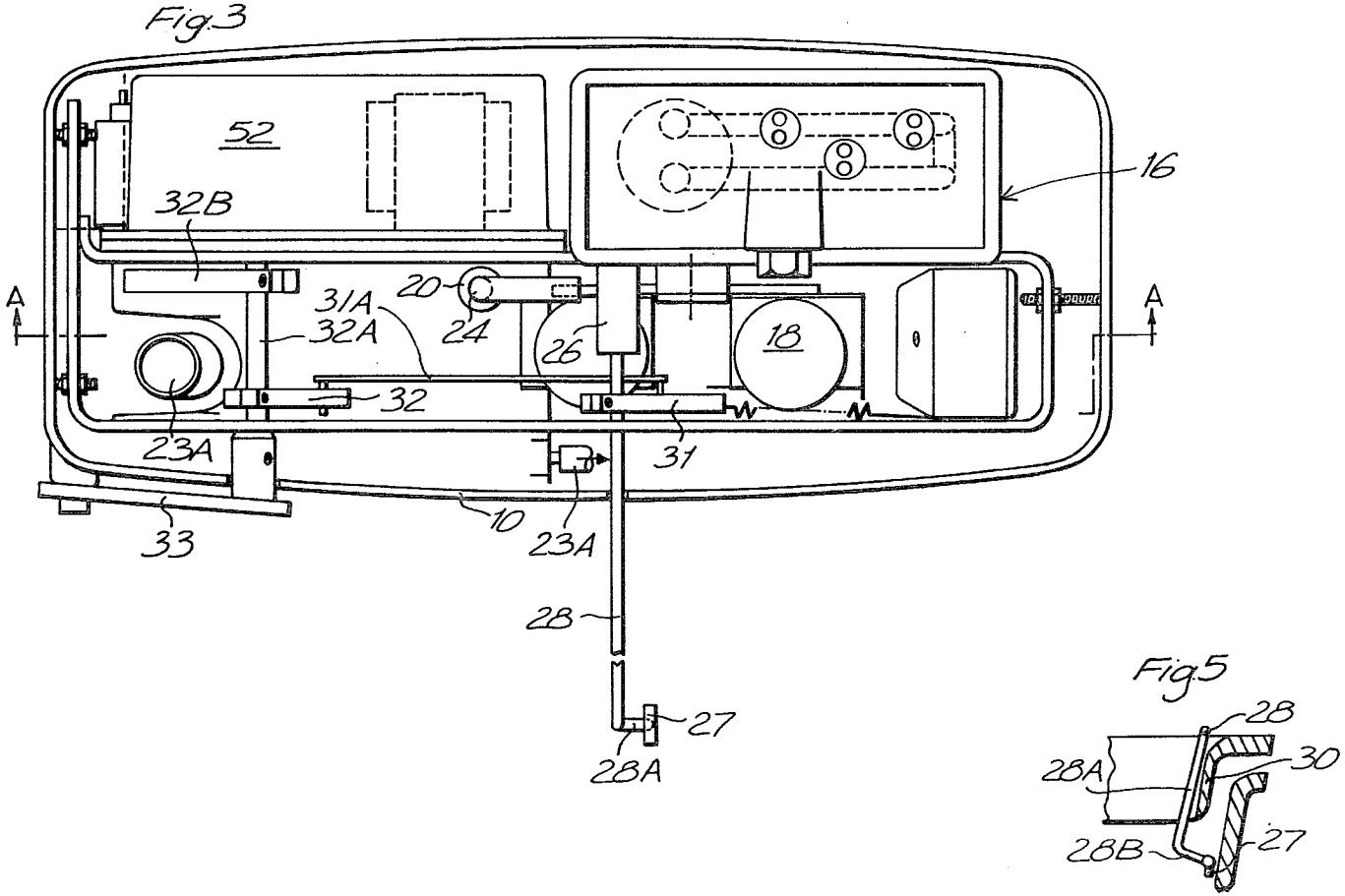
FIG. 3 is a top view with cover removed.
FIG. 5 is a section on the plane 5—5 on FIG. 2.

The outlet pipe 26 is fixed to the container 16 and serves as a bearing for a horizontal pipe 28 the free end of which has an arm 28A at right angles to pipe 26. The end of arm 28A has a bent end 28B which carries a nozzle 27. By rotating the pipe 28 the nozzle can be moved to and from a normal position in which the nozzle is close to and underneath the flushing rim 30 of the toilet pan as shown in FIGS. 2 and 5 and an operative position at about the central area of the pan. The pipe 26 is rotatable by means of a link 31 connected by a rod 31A to a lever 32 by a lost motion pin and slot 31B. The lever 32 is fixed on a spindle 32A on which there is also an operating handle 33 located outside the casing 10.

Figure 6:
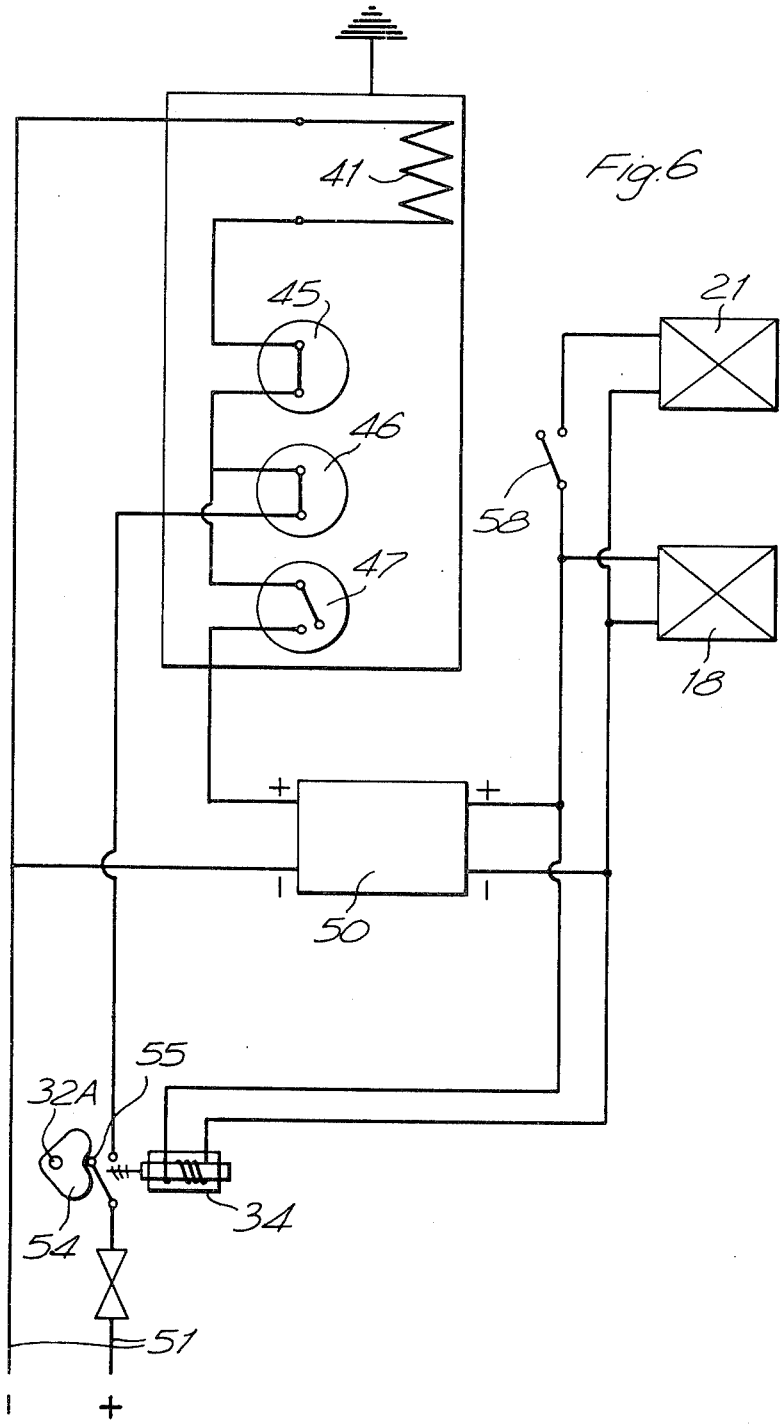
FIG. 6 is an electrical circuit diagram.

The spindle 32A carries a latch bar 32B which is held by a latch 39 acted on by a spring 39A when the handle 33 is moved down to the start position. The latch is releasable by a solenoid 34 (FIG. 6).

Figure 4:
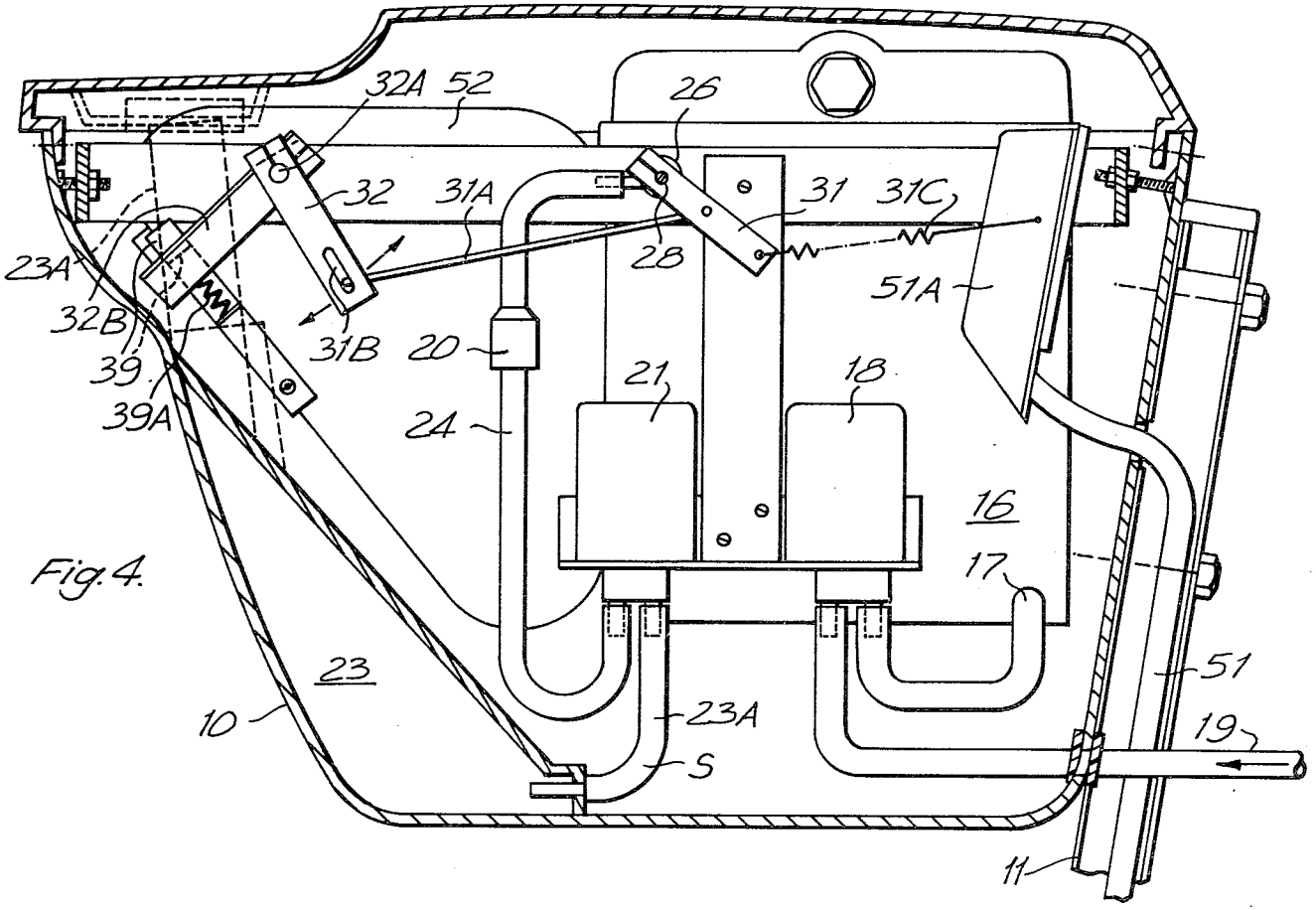
FIG. 4 is a side view with side wall omitted.

The pumps 21, 18 and solenoid 34 are connected in an electrical circuit which includes three thermostats 45, 46, 47 and a transformer 50. The electrical input cable 51 enters through the hollow support 11 (FIG. 4) and connects to a terminal block 51A which connects to the electrical circuit. The electrical circuit parts are contained in a housing 52. The spindle 32A carries a cam 54 (FIG. 6) which actuates a main switch 55. The transformer 50 supplies 12 volt D.C. to the pump motors. The thermostats 45, 46, 47 are located so as to be sensitive to the temperature of the water in the tank and may be set for example at 68° C., 48° C. and 41° C.

The thermostat 47 is normally open and closes when the water in the container 16 reaches 41° C. The other thermostats open if the temperature of the water exceeds 48° C. or in exceptional circumstances 68° C.

The handle 33 carries a push button switch 58 which can be operated by the user to bring the pump 21 into action to supply the additive.

In operation the handle 33 is pushed down from its normal intermediate position to a start position in which it is held by the latch 39 thereby closing switch 55 by the cam 54. This completes the circuit to the heating element 41 via the thermostats 45, 46. This movement of the handle 33 does not move the nozzle because of the lost motion slot 31B. When the water reaches 41° C. the thermostat 47 closes to complete the circuit to the transformer 50 thereby completing the electrical circuit to the pump 18 and energizing the solenoid 34 to release the latch 39 and allow the parts 32B, 32A, 33 to return to the intermediate normal or "off" position under the action of the spring 39A thereby operating the cam 54 to allow the switch 55 to open to disconnect the electrical circuit to the pump 18. The water volume increases with increase of temperature and overflows through the nozzle 27 to push out cold water. The sound of the releasing latch indicates to the user that the water is at the required temperature and a visual indicator can be provided if required. The handle 33 is then raised to an operating position whereby the pipe 28 is rotated to swing the nozzle 27 to its operative position and the cam 54 is moved to close the switch 55 thereby completing the circuit to the pump 18 which then pumps cold water into the bottom of the container 16 thereby discharging warm water from the container 16 through the nozzle 27. At any time in this position the user may operate the button switch 58 to activate the pump 21 to supply additive to the nozzle 27. On release of the handle, the spring 31C returns the handle and arm 28A to normal positions.

The nozzle is washed in position beneath the rim 30 by the normal flush water.

The container 23 has a filler pipe 23A for the additive.

The link 31 is acted on by a light spring 31C.

What I claim is:

1. A bidet or like apparatus having a casing (10), a water container (16) in the casing, a pipe (28) having a horizontal part leading from the upper part of the container to the outside of the casing, said pipe also having a depending part (28A) at the outer end of the horizontal part, said depending part being adapted to extend downwardly into a lavatory pan, said depending part having a rearwardly extending part (28B) at its lower end, said rearwardly extending part having a nozzle, whereby in an out-of-use position the nozzle will be underneath and close to the rim of said pan whereby the nozzle is subjected to the flushing water and means for rotating said pipe about the axis of the horizontal part to bring the nozzle to a raised position about central of said pan.

2. A bidet or like apparatus as claimed in claim 1 comprising a casing (10), a container (16) within the casing for containing water, water pump means (18), means (17) for conveying water from the pump means (18) into the bottom of the container (16), electrical heating means (41) for heating the water in the container, first thermostat means (46) for controlling the normal maximum temperature of the water in the container, a second thermostat means (47) which closes when the water is sufficiently heated and partly closes an electrical circuit to the pump means (18), an operating member (33) having an out of use position and first and second operating positions, an electric switch (55) connectable to complete the electrical circuit with the pump means, heating means and thermostat means, lost motion connecting means (32A 32B, 31B, 31A, 31) between said operating member and the pipe (28) whereby in the first operating position of the operating member (33) the switch (55) is closed to complete the electrical circuit to the thermostat means and heating means without moving the pipe (28) or pump means (18) and in the second operating position the pipe (28) is rotated to swing the nozzle to an operating position and the switch is closed to complete the electrical circuit to the pump which pumps water into the lower part of the container thereby discharging warm water through the pipe (28) and nozzle (27).

3. A bidet or like apparatus as claimed in claim 2 having a latch (39) for holding said pipe and connecting means with the nozzle in its inoperative position in the first operating position of the operating member (33) and means (34) for releasing the connecting means from the latch when said operating member is moved to its second operating position.

4. A bidet or like apparatus as claimed in claim 1 wherein heating of the water in the container causes expansion and overflow of warm water to the nozzle in the first operating position of said operating member thereby providing warm water to the nozzle before use.

5. A bidet or like apparatus as claimed in claim 2 having a reservoir (23) for an additive liquid, an electrically operated pump (21) connected to the reservoir (23) and connected to the nozzle (27), and a switch (58) operable by the user to energize the pump (21) only when the operating means is supplying water to the nozzle.

6. A bidet or like apparatus as claimed in claim 2 having an additional thermostat means (45) which disconnects the circuit to the heating means at a predetermined maximum excessive temperature.

* * * * *